US006840405B2

(12) United States Patent
Schneider

(10) Patent No.: US 6,840,405 B2
(45) Date of Patent: Jan. 11, 2005

(54) FLEXIBLE TUBE PROVIDED WITH A LARGE DIAMETER NECK AND A RIGID END CAP

(75) Inventor: Bernard Schneider, Sainte Menehould (FR)

(73) Assignee: Cebal, S.A., Clichy (FR)

( * ) Notice: Subject to any disclaimer, the term of this patent is extended or adjusted under 35 U.S.C. 154(b) by 0 days.

(21) Appl. No.: 10/324,975

(22) Filed: Dec. 20, 2002

(65) Prior Publication Data

US 2003/0150888 A1 Aug. 14, 2003

Related U.S. Application Data

(63) Continuation-in-part of application No. PCT/FR01/01946, filed on Jun. 21, 2001.

(30) Foreign Application Priority Data

Jun. 21, 2000 (FR) ..... 00 07937

(51) Int. Cl.[7] ..... B65D 35/00
(52) U.S. Cl. ..... 222/92; 222/94; 222/546
(58) Field of Search ..... 222/92, 94, 107, 222/546, 556

(56) References Cited

U.S. PATENT DOCUMENTS

| | | | | | |
|---|---|---|---|---|---|
| 5,497,906 | A | * | 3/1996 | Dubach | 222/23 |
| 5,560,505 | A | * | 10/1996 | Schneider et al. | 215/330 |
| 6,065,643 | A | * | 5/2000 | Harvey et al. | 222/94 |
| 6,170,705 | B1 | * | 1/2001 | Schneider et al. | 222/92 |
| 6,305,577 | B1 | * | 10/2001 | Fillmore et al. | 222/95 |
| 6,550,647 | B1 | * | 4/2003 | Künz | 222/129 |

FOREIGN PATENT DOCUMENTS

| | | |
|---|---|---|
| DE | 8511613 U | 8/1989 |
| EP | 0796801 A2 | 9/1997 |
| FR | 2062086 A | 6/1971 |

* cited by examiner

*Primary Examiner*—Joseph A. Kaufman
(74) *Attorney, Agent, or Firm*—Ohlandt, Greeley, Ruggiero & Perle

(57) ABSTRACT

There is a flexible tube having a neck in which an outer surface has a securing attachment and a transverse end wall bearing a cylindrical vent. There is also a rigid end cap having a sealing shirt and a securing skirt having a securing attachment matching that of the neck. The vent of the flexible tube and sealing and securing skirt are arranged so as to obtain longitudinal locking of the rigid end cap on the neck by a simple longitudinal translational movement.

24 Claims, 3 Drawing Sheets

FLEXIBLE TUBE PROVIDED WITH A LARGE DIAMETER NECK AND A RIGID END CAP

CROSS-REFERENCE TO A RELATED APPLICATION

This application is a continuation-in-part application of PCT/FR01/01946, filed Jun. 21, 2001, which claims priority from French Application 00/07937, filed Jun. 21, 2000. The contents of PCT/FR01/01946 and 00/07937 are incorporated herein by reference.

BACKGROUND OF THE INVENTION

1. Field of the Invention

The invention relates to the packaging of liquid to paste substances in a flexible tube above which a rigid end cap is fitted, the said tube having a head comprising a flexible skirt connected through a shoulder to an approximately cylindrical neck, the said rigid end cap being designed to be fixed irreversibly to the head of the said tube.

2. Description of the Prior Art

The distribution end of most flexible tubes terminates with a neck delimiting a distribution channel and provided with an external thread on which a removable cap will be fitted. These plugs are usually small and have at least two disadvantages: firstly, they are easily lost by users and secondly it is difficult to hold the tube with head downwards in a stable manner, in a vertical position to make the tube look attractive and to facilitate gripping which is particularly appreciated by consumers.

This is why it is known how to replace these caps with larger diameter and stiffer caps fixed on one end of the tube. This greater stiffness can be achieved by increasing the thicknesses of the different parts forming the head, but this would increase the cost of the tube and its weight. This is why it is preferred to use a more rigid plastic material for plastic tubes. But in this case, the incompatibility in melting of the plastic from which the flexible skirt is made and the plastic that increases the stiffness of the end of the tube makes it preferable to mould the flexible tube and the said end (that we will call the "rigid end" in the remainder of this presentation) separately, and consequently the rigid end must subsequently be fixed reversibly on the head (which is more flexible) of the flexible tube.

The rigid end cap may be of several different natures: a simple rigid end cap base keeping the tube with the head facing downwards stable in the vertical position ("standup" tube) and a closing device called a service capsule, comprising a part that will be fixed on the neck of the tube (called the bottom) and a moving part called the cap, that pivots about a hinge attached to the said base and comprising means of closing off the distribution channel.

The attachment of this rigid end cap to the head of the flexible tube must be made in an economically satisfactory manner under high speed manufacturing conditions, in other words at a speed of the order of one or several hundred tubes per minute. For example, French patent application FR 2 650 253 issued by the applicant presents a rigid end cap and a tube with a neck, both being fitted with matching irreversible securing means; the neck is force fitted between two skirts attached to the bottom of the rigid end cap: a sealing skirt entering the inside of the neck and a skirt provided with securing means comprising engraving ribs and a click fit rim. This document recommends that three steps should be adopted in order to limit the forces necessary for attachment.

These three steps are insertion of the sealing skirt into the orifice, etching of the ribs on the outside surface of the neck, and then click fitting.

When the rigid end caps are service capsules, the industrial attachment onto the head of the tube also causes a problem of orientation of the hinge with respect to the printed decor on the skirt and the end seam (called the terminal seam). Patent application FR 2 707 256 issued by the applicant proposes a solution for solving this orientation problem. It describes a capsule and a receptacle fitted with a neck, the capsule and the neck being provided with the means cooperating with each other to create an irreversible attachment; the neck is force fitted between two central skirts of the capsule, a sealing skirt entering the inside of the neck and a skirt provided with click fit rims for longitudinal locking. Rotational locking is achieved by trapping a flexible axial strip free to move radially between two profiled portions. The flexible strip is attached to the capsule and the profiled portions are attached to the top of the shoulder, close to the bottom of the neck.

FR 2 650 253 and FR 2 707 256 present high performance systems for the attachment of a rigid end cap to a flexible tube head. However, sealing at the contact between the sealing skirt of the rigid end cap and the internal wall of the neck can only be achieved if the inside diameter of the neck is sufficiently small compared with its outside diameter. It is observed that if the opening of the neck is large compared with the outside diameter of the neck, a force imposed on the shoulder of the tube, particularly at the junction between the shoulder and the skirt, would cause ovaling of the neck, and consequently its attachment to the sealing skirt of the rigid end cap is not leak tight. Therefore, this limits possibilities of use of rigid end caps fixed on flexible tubes, particularly when a multiple distribution orifice or an offset orifice is necessary, these two cases making it necessary to have a tube for which the diameter of the neck is large compared with the diameter of the flexible skirt.

Therefore, the applicant wanted to develop a flexible tube and rigid end cap assembly that could be fixed onto the said tube with a leak tight joint under economically satisfactory high speed industrial conditions, the said tube having a head comprising a neck continuing from a shoulder and the neck is approximately cylindrical with a large diameter, in other words larger than the diameter of the skirt.

SUMMARY OF THE INVENTION

A first purpose of the invention is a flexible tube associated with a rigid end cap that will be fixed on the said tube in a leak tight manner. A second purpose of the invention is the said rigid end cap associated with the flexible tube according to the invention. A third purpose of the invention is the flexible tube assembly according to the invention, on top of which the rigid end cap according to the invention is placed.

The tube according to the invention is made from a material that confers good flexibility to it. The materials are chosen as a function of the final use of the tube. When packaging tubes for hygiene or cosmetic products for which the tube must have good barrier properties, the flexible skirt is composed of a PE/EVOH/PE type laminated or co-extruded multiple layer, where PE is polyethylene and EVOH is the ethylene-vinyl alcohol copolymer. Before being filled with the product to be packaged, the tube has a circular cylindrical or elliptical skirt. The head comprises a neck and a shoulder connecting the said flexible skirt to the neck. Since this head will be completely covered by the rigid end cap, excellent barrier properties are not necessary and a simple polyethylene moulded head is satisfactory in most cases. Nevertheless, if these barrier properties have to be improved, a barrier insert like that described by the applicant in European patent EP 0 524 897 can be added, or a PE/EVOH/PE co-injected head can be made using the process described by the applicant in international patent application WO/FR99/02525. The diameter of the approximately cylindrical neck large, in other words its diameter is one third larger than the diameter of the said skirt. When the skirt is cylindrical and has an elliptical orthogonal section (it will be said that the skirt is "elliptical" in the remainder of this presentation), the diameter of the neck is one third larger than the small axis of the barrier elliptic between the flexible skirt and the shoulder.

The tube according to the invention is characterized in that above the top of the neck there is a transverse end wall on which a cylindrical vent is supported and that delimits a channel inside which a sealing skirt attached to the bottom of the rigid end cap will be inserted, the inside diameter of the said channel being approximately equal to, and preferably slightly less any, the outside diameter of the sealing skirt of the rigid end cap.

According to the invention, the transverse end wall of the neck of the flexible tube is approximately perpendicular to the centre line of the neck. It extends above the top of the neck, from the vent towards the neck. Its must be long enough so that the deformation imposed at the base of the tube shoulder is not transmitted to the vent, so that the sealing skirt of the rigid end cap can remain in contact with the vent. Therefore, this extent depends on the mechanical properties of the plastic material being used. For example, for a tube with a flexible skirt with a diameter of 38 mm and a low density polyethylene head fitted with a 25 mm diameter neck, the said transverse end wall stretches over a difference in diameter of the order of 3 mm (the difference between the inside diameter of the neck and the outside diameter of the vent), the wall thicknesses being approximately 1 mm near this end of the head (neck, transverse wall, vent).

The extent of this transverse end wall cannot be too long, firstly because in this case the diameter of the neck would be reduced which would be contrary to the required purpose, and secondly because there is a minimum stiffness of the vent necessary to facilitate penetration of the flexible sealing skirt of the rigid end cap inside its channel. If the vent is too flexible, there is a risk that alignment defects between the tube and the end cap could be amplified. With a geometry like that described above, it is desirable to limit the extent to a difference in diameter of the order of 10 mm. Thus, the radial extent of this transverse end wall is between 0.5 and 5 times the average thickness of the top of the neck, and preferably between 1 and 3 times the average thickness of the top of the neck.

DETAILED DESCRIPTION OF THE INVENTION

Preferably, the said vent extends on each side of the transverse end wall. Thus, the level of the top part of the vent is such that part of the vent projects beyond the transverse end wall. In this way, the attachment of the rigid end cap onto the head of the flexible tube begins by inserting the sealing skirt of the rigid neck inside the said vent. Typically, the objective is that the height should be the height of the vent and therefore the height of the contact between the vent and the sealing skirt, should be more than three times the thickness of the transverse end wall, since it is usually observed that there is a slight radial shrinkage of the portion of the vent wall adjacent to the said transverse end wall, during cooling after moulding. Consequently, with a vent extended on each side of the transverse end wall and with a height more than three times greater than the thickness of the said transverse end wall, a leak tight contact is obtained between the sealing skirt and the vent on each side of this portion of the vent wall adjacent to the said transverse end wall.

For example, for the low density polyethylene tube described above with a diameter of 38 mm and a 25 mm neck, the vent typically projects 1 mm beyond the transverse end wall. Its inside diameter is 19 mm and its height is about 3 mm. The sealing skirt of the rigid end cap is sufficiently long so that contact between the vent and the sealing skirt can be made over this height.

The rigid end cap according to the invention is made from a material that is stiffer than the material from which the tube is made. When the head of the flexible tube is made from a high density polyethylene, the end cap is typically made from polypropylene. It is provided with at least one sealing skirt and a skirt provided with irreversible securing means, such as click fit rims that will cooperate with the outer wall of the tube neck, itself provided with irreversible matching securing means. We will subsequently call this skirt the securing skirt. Securing is said to be irreversible in the sense that it is no longer possible to detach the rigid end cap from the tube head without destroying a part of the assembly.

The rigid end cap according to the invention is characterized in that the diameter of its sealing skirt is slightly greater than the inside diameter of the vent of the tube and in that its securing skirt comprises at least two flexible areas, preferably uniformly distributed. The end cap must penetrate into the tube head to fix it under acceptable industrial conditions, requiring the lowest possible forces. Attachment begins by forcing the sealing skirt to penetrate inside the tube vent, with fairly small squeezing, typically 0.1 to 0.2 mm at the radius. The stiffness of the securing skirt must be sufficient so that the said securing means (second securing means) can fulfil their function of matching the securing means (first securing means) fitted on the tube neck. However, flexible areas are provided on the said securing skirt of the end cap, to ensure that the penetration force is not too high. For example, these zones may be slits or grooves over more than half of the height of the said skirt and opening out at the open end of the skirt, which means that the end of the skirt has a given circumferential flexibility. Grooves are preferred to slits, to facilitate moulding and simplify tooling, since grooves are simply thinner areas in which the skirt is replaced locally by a circumferential film. Typically, for a rigid end cap associated with the flexible tube with the geometry described above, the inside diameter of the securing skirt is 25 mm, its thickness is 1.5 mm, its height is 4 mm, and there are three flexible areas in which the skirt is replaced locally by 0.3 mm thick film over a height of 3 mm.

Therefore, close to its open end, the securing skirt is composed of strips with ends flexible in the radial direction, and are regularly distributed and separated by these flexible areas. They are provided with securing means that achieve longitudinal locking in cooperation with matching means located on the neck of the flexible tube For example, they may consist of click fit rims with an approximately equal radial height, one of which is located on the securing skirt, the other is located on the outside surface of the neck. The radial height of these rims must be sufficiently large for good trapping and to prevent any longitudinal shrinkage movement of the end cap with respect to the tube, and it must be sufficiently small so that the end cap can be pushed in with limited force. Thus, with the previous geometry, the radial height of the rim will be 1 mm; in this way, even with a minimum clearance (about 0.2 mm) between the inside diameter of the securing skirt and the outside diameter of the neck, the penetration force is still less than 25 daN, and even with a maximum clearance (0.5 mm) between the inside diameter of the securing skirt and the outside diameter of the neck, longitudinal trapping is still guaranteed under standard conditions of use of the flexible tubes.

The sealing skirt of the rigid end cap must be inserted into the tube under satisfactory high speed industrial conditions. To achieve this, the said sealing skirt preferably has a chamfer on its open end to facilitate centring with respect to the vent of the flexible tube at the beginning of penetration of the rigid end cap onto the tube head. Furthermore, the securing skirt is preferably provided with longitudinal guide ribs on its inside wall close to its fastening on the rigid end cap, which can maintain the alignment of the sealing skirt with the centre line of the vent of the flexible tube.

Rotational locking may be achieved if the tube is a circular cylindrical tube, using a flexible strip (attached to the end cap) and profiled portions (attached to the shoulder) described in FR 2 707 256. If the tube is elliptical, it may be achieved by the device developed by the applicant and described in French patent application No. FR9901530, in which a discontinuous annular rib located on the neck above the click fit rim acts as a lock in which this securing skirt, formed from parts separated by uniformly distributed slits with unequal extents, is inserted like a key.

The geometry of the sealing and securing skirts of the rigid end cap and the geometry of the neck and the vent of the flexible tube are such that they can enable a production rate of several hundred tubes per minute under satisfactory industrial conditions, and can make a sealed attachment with longitudinal locking of the rigid end cap on the neck by a simple longitudinal translational movement applying a force of not more than 25 daN.

Therefore, preferably, the procedure for fixing the rigid end cap on the head of the flexible tube follows the following sequence of steps:

1) The rigid end cap is brought up to the head of the flexible tube;
2) Longitudinal movement of the end cap towards the tube where the chamfer located on the sealing skirt of the rigid end cap facilitate centring of this end cap with respect to the vent of the flexible tube;
3) Start forced penetration of the sealing skirt into the said vent;
4) Longitudinal movement of the end cap towards the tube in which the guide ribs located on the securing skirt of the rigid end cap preferably centre this end cap with respect to the vent of the flexible tube;
5) The end of the securing skirt, made flexible in the radial direction due to the flexible zones, is forced along a centrifugal radial direction under the effect of the penetration force due to the obstacle formed by the click fit rim located on the outside surface of the neck;
6) At the end of the penetration and after passing the previous obstacle, the end of the skirt stops suddenly and is trapped;
7) Slight rotational movement to make the securing means, like those described in FR 2 707 256, active in rotation.

BRIEF DESCRIPTION OF THE DRAWINGS

The figures illustrate three embodiments of the invention described later in the examples.

EXAMPLES

Example 1

Figure 1:
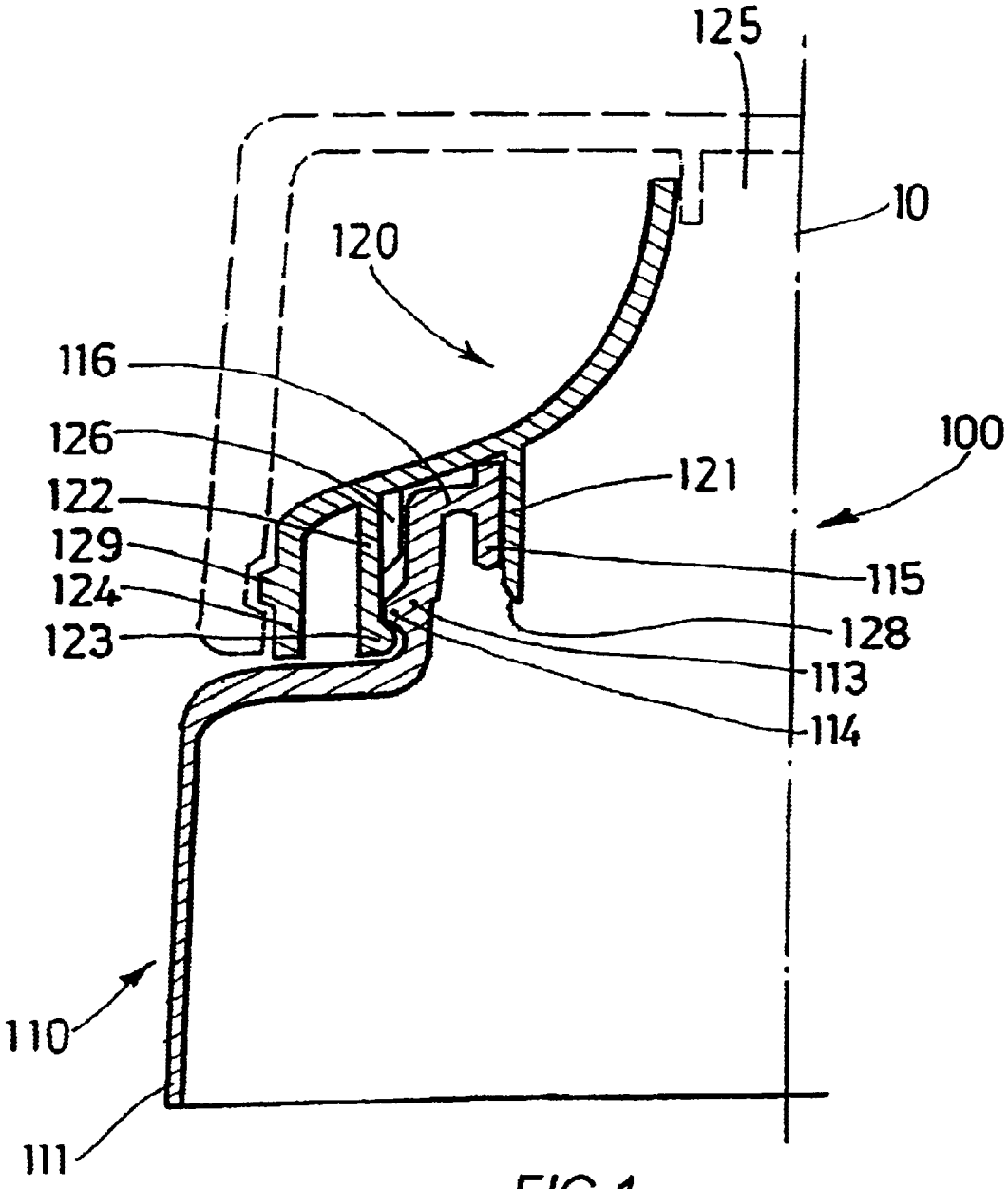
FIG. 1 illustrates a half-section of the head of the flexible tube according to the invention and a simple rigid end cap according to the invention, fixed onto the flexible tube such that the assembly forms a "stand-up" tube.

Simple End Cap for Stand-Up Tube (FIG. 1)

In this case, the rigid end cap is a simple rigid end cap, itself provided with a distribution neck. An outer skirt with a diameter approximately the same as the diameter of the skirt of the tube is attached to the bottom of the end cap, to facilitate holding the tube in the vertical position with the head down. The end cap may be provided with a screw thread located either on the neck, or away the neck close to the large diameter as in the case shown, which makes it possible to improve the aesthetics of the neck, for example to give it the appearance of a smooth nozzle in the form of a hyperbolic form of revolution with one sheet.

FIG. 1 illustrates such an assembly 100. The flexible tube 110 is provided with a cylindrical flexible skirt 111 with a circular orthogonal section with a diameter of 40 mm, composed of a PE/EVOH/PE coextruded multiple layer. The approximately cylindrical neck 113 has a diameter of 35 mm, which is one third larger than the diameter of the said skirt.

Above the neck 113, there is a transverse end wall 116, supporting a cylindrical vent 115 that delimits a channel inside which the sealing skirt 121 attached to the bottom of the rigid end cap 120 is inserted when the rigid end cap 120 is fixed onto the rigid tube 110. The inside diameter of the vent 115, approximately 26 mm, is approximately equal to or slightly less than (by about 0.2 mm) the outside diameter of the sealing skirt 121 of the rigid end cap 120.

The transverse end wall 116 is approximately perpendicular to the axis 10 of the neck. It extends over a difference in diameter of about 3.5 mm (the difference between the inside diameter of the neck and the outside diameter of the vent), the wall thicknesses being approximately 1 mm close to this end of the neck (neck, transverse wall, vent).

The vent 115 projects by about 1 mm beyond the transverse end wall. Its height is approximately 4 mm. The sealing skirt 121 of the rigid end cap 120 is approximately 7 mm high and is sufficiently long so that contact can be made between the vent and the sealing skirt over the full height of the vent.

The rigid end cap 120 is made of polypropylene. The diameter of the distribution orifice 125 is 10 mm.

The rigid end cap 120 is provided with a sealing skirt 121 and a securing skirt 122 fitted with a click fit rim 123 that will cooperate with the rim 114 located on the outer wall of the neck 113 of the flexible tube 110. The diameter of the sealing skirt 121 is slightly greater than the inside diameter of the vent of the tube The securing skirt 122 is 1.6 mm thick at the rim 123, and comprises three uniformly distributed thinner areas not shown on FIG. 1, in which a 0.3 mm thick and 1.5 mm wide film extends over a height of 4 mm.

The radial height of the click fit rims 123 and 114 is 1 mm.

The sealing skirt 121 has a chamfer 128 at its open end which facilitates centring it at the time that the rigid end cap 120 is attached onto the head of the flexible tube 110. Longitudinal guide ribs 126 are provided on the inside wall of the securing skirt 122, close to its attachment with the rigid end cap 120, to complete centring of the said securing skirt 122 on the neck 113, thus improving the alignment of the centre line of the sealing skirt with the centre line of the vent of the flexible tube.

The rigid end cap 120 has an outer skirt 124 with a diameter approximately the same as the diameter of the skirt 111 of the flexible tube 110 and is provided with a screw thread 129 that makes it possible to fix a cap closing off the distribution orifice 125.

Example 2

Figure 2:
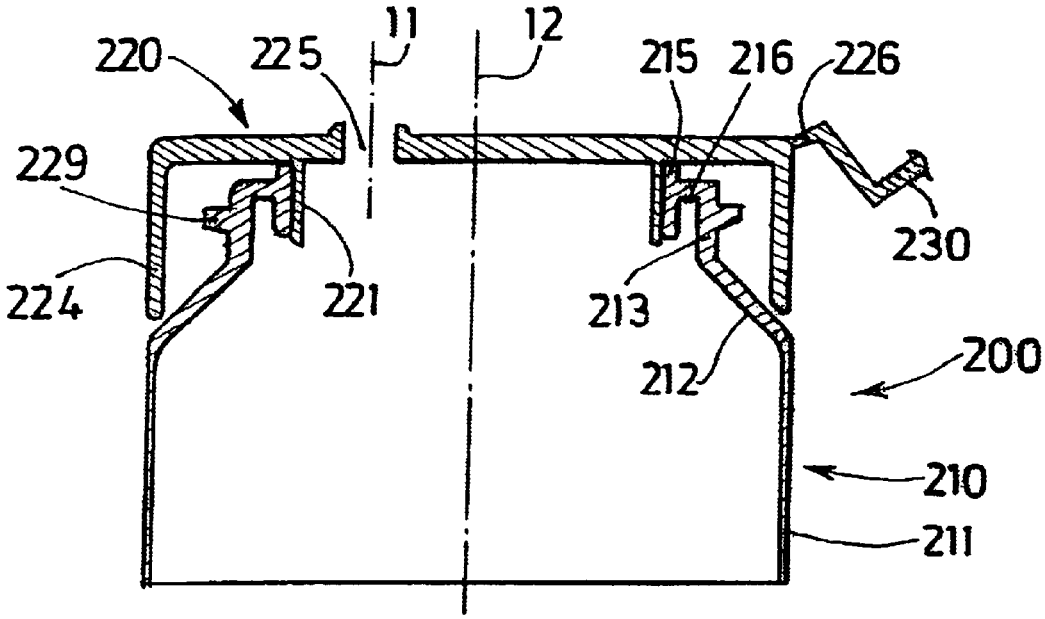
FIG. 2 illustrates a section through a flexible tube according to the invention and a service capsule with an offset distribution orifice fixed onto the flexible tube.

Service Capsule with an Offset Distribution Orifice (FIG. 2)

The rigid end cap may also be a service capsule with a pivoting cap and an offset distribution orifice.

This is illustrated in FIG. 2 where the tube 200 is made by assembling a flexible tube 210 with an elliptical flexible skirt 211 and a neck 213 with a service capsule 220. It is a section through a plane passing through the small axis: the cap 230 pivots about a hinge 226 that is approximately parallel to the large axis. Since the objective is to maximize the distance between the distribution orifice 225 and the hinge 226, it is necessary to offset the orifice 225 from the centre line 12 of the neck of the flexible tube, which makes it necessary to have a neck 213 with a larger diameter than the small axis of the skirt 211.

Rotational locking is important because the cap 230 must be placed correctly with respect to the decor printed on the elliptical skirt 211, and is achieved using the securing device developed by the applicant and described in the French application patent FR9901530. FIG. 1 in this application may be used to complete this description, provided that the diameter of the neck is considered to be proportionally larger (compared with the diameter of the flexible skirt of the tube) and that the shape of the neck is corrected such that it is provided with a transverse end wall and a vent.

FIG. 1 in patent application FR9901530 may then be considered as a section formed by a plane passing through the centre line 12 of the orifice and parallel to the axial plane passing through the large axis. The annular discontinuous rib 229 (reference 4 in this application) located on the neck above the click fit rim (reference 6 in this application) acts as a lock in which a set of two diametrically opposite axial strips (reference 12*a* and 12*b* in this application) with unequal lengths, is inserted like a key, the said assembly forming the securing skirt according to the invention provided in this case with slits acting as flexible zones. These two parts behave like flexible circular strips. They are provided with a click fit rim (reference 16 in this application) and longitudinal guide ribs (reference 17 in the said request). Once the key (securing skirt) has been engaged in the lock (discontinuous annular rib 229), an axial translation movement unit is applied to the capsule 220 until it is immobilized and fixed by a click fit. Precise positioning is achieved by the inclined shoulder 212 that guides the base of the capsule towards the required final position during penetration.

The section in FIG. 2 passing through the slits, its securing skirt, the click fit rim and the guide ribs are not shown.

The flexible tube 210 is provided with an elliptical flexible skirt 211 with a 65 mm large axis and a 30 mm small axis, composed of a PE/EVOH/PE coextruded multiple layer. The neck 213 is approximately cylindrical and its diameter is 22 mm.

The neck 213 is provided with a transverse end wall 216 on top, supporting a cylindrical vent 215 with an inside diameter close to 16 mm and approximately equal to or slightly less than the outside diameter of the sealing skirt 221 of the service capsule 220 (by the order of 0.2 mm).

The transverse end wall 216 extends over a difference in diameter of approximately 1.6 mm (the difference between the inside diameter of the neck and the outside diameter of the vent), the thicknesses of the wall being approximately 1 mm near this end of the head (neck, transverse wall, vent).

The vent 215 projects by about 1 mm beyond the transverse end wall. Its height is approximately 4 mm, like the sealing skirt 221 of the service capsule 220.

The service capsule 220 is made of polypropylene. Its base has an offset distribution orifice 225 with a diameter of 3 mm. It is fitted with a sealing skirt 221 and a discontinuous securing skirt, not shown on the figure, on which there is a click fit rim which will cooperate with the rim located on the outer wall of the neck 213 of the flexible tube 210. The diameter of the sealing skirt 221 is slightly greater than the inside diameter of the vent of the tube. The radial height of the click fit rims is about 1 mm.

Example 3

Figure 3:
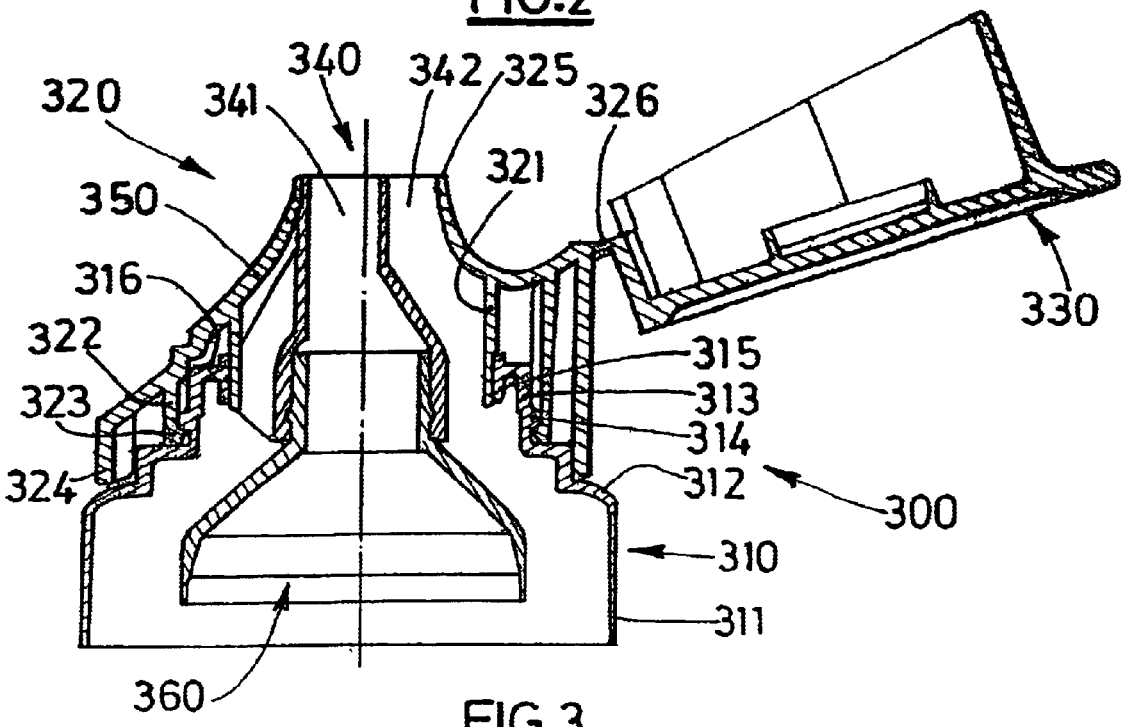
FIG. 3 illustrates a section through a flexible tube according to the invention and a service capsule with a multiple distribution orifice fixed onto the flexible tube.

Service Capsule with a Multiple Distribution Orifice (FIG. 3)

In another embodiment shown in FIG. 3, the rigid end cap is a service capsule 320 with a pivoting cap 330 that will close a multiple orifice 325 designed to simultaneously distribute at least two different products.

The supply channels 341 and 342 direct the different paste products that are to be extruded simultaneously with geometries that are difficult to make in a single piece. Therefore, in this case the service capsule 320 is moulded in two parts: a central part 340 that shares the same flows, and an outer part 350 provided with a sealing skirt 321 and a securing skirt 322 according to the invention.

The flexible tube 310 is provided with a flexible cylindrical skirt 311 with a 38 mm diameter orthogonal circular cross section. The diameter of the approximately cylindrical neck 313 is approximately 25 mm. Above the neck 313, there is a transverse end wall 316 supporting a cylindrical vent 315 with an inside diameter approximately 19 mm and slightly less than the outside diameter of the sealing skirt 321 of the service capsule 320 (of the order of 0.2 mm).

The transverse end wall 316 is approximately perpendicular to the axis of the neck. It extends over a difference in diameter of about 3.5 mm (the difference between the inside diameter of the neck and outside diameter of the vent), the wall thicknesses close to this end of the head (neck, transverse wall, vent) being about 1 mm.

The vent 315 projects by about 1 mm beyond the transverse end wall. Its height is about 4 mm. The height of the sealing skirt 321 of the service capsule is variable, and the minimum is about 7 mm. It is sufficiently long for the contact between the vent and the sealing skirt to be made over the full height of the vent.

The service capsule 320 is made of polypropylene. The distribution orifice 325 is a multiple orifice with a diameter of 10 mm. The service capsule is fitted with a sealing skirt 321 and a securing skirt 322, itself provided with a click fit rim 323 that will cooperate with the rim 314 located on the outer wall of the neck 313 of the flexible tube 310. The diameter of the sealing skirt 321 is slightly greater than the inside diameter of the vent of the tube. The securing skirt 322, is 1.6 mm thick at the rim 323, and comprises three thinner uniformly distributed zones not shown on FIG. 3, in which a 0.3 mm thick and 1.5 mm wide film extends over a height of 4 mm.

The radial height of the click fit rims 323 and 314 is 1 mm.

The sealing skirt 321 is provided with the chamfer at its open end, to facilitate its centring when the rigid end 320 is attached onto the head of the flexible tube 310.

Circumferential locking is achieved by means of the flexible strip (attached to the end cap) and profiled portions (attached to the shoulder) described in FR 2 707 256, not shown on FIG. 3 and located in space between the securing skirt 322 and the outer skirt 324 of the service capsule 320.

Example 4

Figure 4:
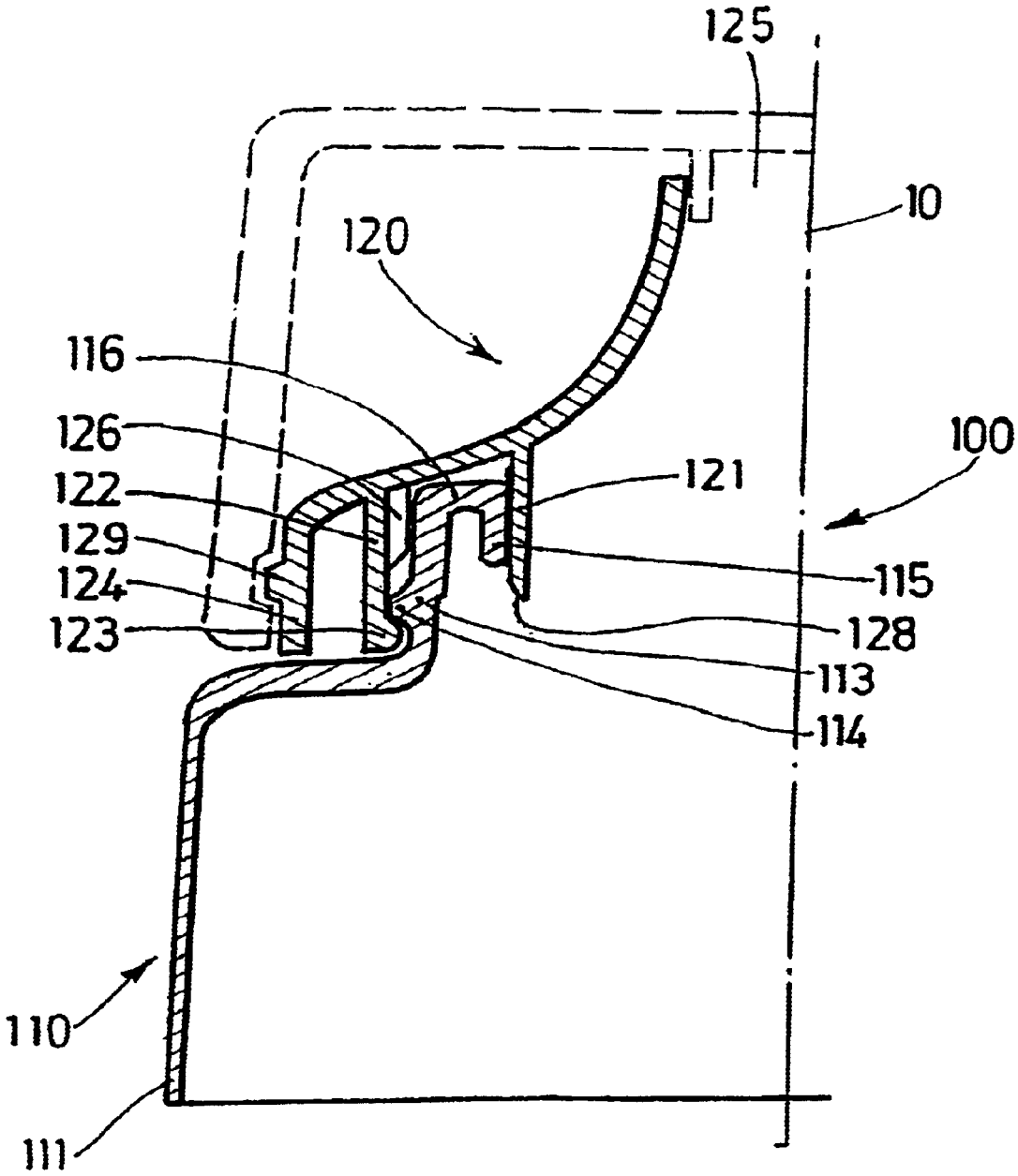
FIG. 4 illustrates a half-section of another embodiment of the head of the flexible tube according to the present invention and a simple rigid end cap according to the invention, fixed onto the flexible tube such that the assembly forms a "stand-up" tube.

Simple End Cap for Stand-Up Tube (FIG. 4)

The end cap shown in FIG. 4 is substantially similar to and is described in like manner at the end cap shown in FIG. 1 in Example 1 except that the configuration for the transverse end wall 116 and cylindrical vent 115 (or chimney 115) is different. In FIG. 4, the cylindrical vent 115 extends entirely below or underneath transverse end wall 116 (in FIG. 1, cylindrical vent 115 extends both above and below transverse end wall 116). In the cross-section view in FIG. 4, the configuration of transverse end wall 116 and cylindrical vent 115 is of a "U" shape.

The configurations of cylindrical vent 115 and transverse end wall 116 in the end caps shown in FIGS. 1 and 4 provides enhanced tightness and integrity of seal compared to end caps of the prior art, particularly those shown in German Utility Model No. G8511613U. Although not bound by any theory, the enhanced tightness may be due to smaller global deformation of the cylindrical vent when the external tube skirt is pressed by the fingers of the consumer near the junction between the skirt and shoulder (smaller lever arm). Also, deformation of the cylindrical vent may have the effect of a local displacement of the cylindrical vent in the direction of the cap skirt (rather than the opposite direction as in the end cap shown in G8511613U), which reduces leakage.

What is claimed is:

1. A flexible tube for receiving a rigid end cap, comprising a flexible skirt and a head, said head having a neck and a shoulder connecting said neck to said flexible skirt, said neck having an external diameter larger than a third of the diameter of said flexible skirt, said neck having an external surface supporting a first securing means, said rigid end cap having a second securing means matching with said first securing means, said neck being surmounted by a transverse end wall bearing a cylindrical vent, said cylindrical vent having a diameter slightly less than the external diameter of a seal skirt of said rigid end cap, said cylindrical vent extending above and below the transverse end wall.

2. The flexible tube according to claim 1 wherein said cylindrical vent extends on both sides of said transverse end wall.

3. The flexible tube according to claim 1, wherein the radial extension of said transverse end wall is between 0.5 and 5 times the average thickness of the top of the neck.

4. The flexible tube according to claim 1, wherein said cylindrical vent has a height larger than three times the thickness of the transverse end wall.

5. A rigid end cap to be fixed onto the flexible tube according to claim 1, said rigid end cap being provided with a seal skirt and a securing skirt, said securing skirt having said second securing means, said securing skirt having at least two areas for flexibility.

6. The rigid end cap according to claim 5, wherein said securing skirt has an open end, wherein said areas for flexibility are regularly distributed slits, and wherein said slits exceed half of the height of said securing skirt and open onto the open end of said skirt.

7. The rigid end cap according to claim 5, wherein said areas for flexibility are thinned portions of said securing skirt.

8. The rigid end cap according to claim 5, further comprising a base and a cap pivoting around a hinge fixed to said base.

9. The rigid end cap according to claim 8, wherein the base has a decentered dispensing orifice.

10. The rigid end cap according to claim 8, wherein the base has multiple dispensing orifice.

11. The flexible tube according to claim 1, wherein said matching first and second securing means provide an irreversible attachment between said neck and said rigid end cap.

12. The flexible tube according to claim 11, wherein said transverse end wall is approximately perpendicular to the centre line of said neck.

13. The flexible tube according to claim 1, wherein said transverse end wall is approximately perpendicular to the centre line of said neck.

14. An assembly of a flexible tube and of a rigid end cap, said flexible tube comprising a flexible skirt and a head, said head having a neck and of a shoulder connecting said neck to said flexible skirt, said neck having an external diameter larger than a third of the diameter of said flexible skirt, said neck having an external surface supporting a first securing means, said rigid end cap including a seal skirt and a securing skirt having a second securing means matching with said first securing means, said neck being surmounted by a transverse end wall bearing a cylindrical vent, said cylindrical vent having a diameter slightly less than an external diameter of said seal skirt, said securing skirt having at least two areas for flexibility, the cylindrical vent extending above and below said transverse end wall.

15. The assembly according to claim 14, wherein said neck and said seal and securing skirts are positioned in order to obtain longitudinal locking of said rigid end cap on the neck by performing a longitudinal translation movement not requiring a force larger than 25 daN.

16. The assembly according to claim 14, wherein said flexible skirt is elliptical, wherein said neck is substantially cylindrical and has a discontinuous annular rib playing the role of a lock in which separate portions of said securing skirt are inserted like a key.

17. The assembly according to claim 14, wherein said rigid end cap has a base to which is fixed a radially flexible strip, and wherein said flexible tube has profiled portions fixed to the shoulder, said flexible strip and said profile portions being positioned in order to obtain, at the end of a pushing operation and by means of a slight relative rotational movement between said rigid end cap and said flexible tube, locking against rotation of said rigid end cap with respect to said flexible tube.

18. The assembly according to claim 14, wherein said matching first and second securing means provide an irreversible attachment between said neck and said rigid end cap.

19. The assembly according to claim 18, wherein said transverse end wall is approximately perpendicular to the centre line of said neck.

20. The assembly according to claim 14, wherein said transverse end wall is approximately perpendicular to the centre line of said neck.

21. A flexible tube for receiving a rigid end cap, comprising a flexible skirt and a head, said head having a neck and a shoulder connecting said neck to said flexible skirt, said neck having an external diameter larger than a third of the diameter of said flexible skirt, said neck having an external surface supporting a first securing means, said rigid end cap having a second securing means matching with said first securing means, said neck being surmounted by a transverse end wall bearing a cylindrical vent, said cylindrical vent having a diameter slightly less than an external diameter of a seal skirt of said rigid end cap, said cylindrical vent extending below said transverse end wall.

22. The flexible tube according to claim 21, wherein said transverse end wall is approximately perpendicular to the centre line of said neck.

23. An assembly of a flexible tube and of a rigid end cap, said flexible tube comprising a flexible skirt and a head, said head having a neck and of a shoulder connecting said neck to said flexible skirt, said neck having an external diameter larger than a third of the diameter of said flexible skirt, said neck having an external surface supporting a first securing means, said rigid end cap including a seal skirt and a securing skirt having a second securing means matching with said first securing means, said neck being surmounted by a transverse end wall bearing a cylindrical vent, said cylindrical vent having a diameter slightly less than an external diameter of said seal skirt, said securing skirt having at least two areas for flexibility, said cylindrical vent extending below said transverse end wall.

24. The assembly according to claim 23, wherein said transverse end wall is approximately perpendicular to the centre line of said neck.

* * * * *